US005924266A

United States Patent [19]

Salvador

[11] Patent Number: 5,924,266

[45] Date of Patent: Jul. 20, 1999

[54] LOAD CENTER PACKAGING WITH AN INTEGRAL LOAD CENTER PROTECTOR

[75] Inventor: Reynoldo Salvador, Duluth, Ga.

[73] Assignee: Siemens Energy & Automation, Inc., Alpharetta, Ga.

[21] Appl. No.: 08/915,245

[22] Filed: Aug. 19, 1997

Related U.S. Application Data

[62] Division of application No. 08/688,915, Jul. 31, 1996.

[51] Int. Cl.[6] ..... B65B 23/00; B65B 7/28

[52] U.S. Cl. ..... 53/472; 53/485; 53/487; 206/701

[58] Field of Search ..... 53/397, 410, 458, 53/472, 156, 580, 492, 485, 487, 290, 296; 206/701

[56] References Cited

U.S. PATENT DOCUMENTS

| | | | |
|---|---|---|---|
| 1,644,782 | 10/1927 | Lander . | |
| 1,787,498 | 1/1931 | Tinsley | 206/521 |
| 2,031,111 | 2/1936 | Kondolf | 229/16 |
| 2,398,901 | 4/1946 | West . | |
| 3,061,083 | 10/1962 | Hubbell . | |
| 3,639,937 | 2/1972 | Sweeney | 15/104.8 |
| 3,701,465 | 10/1972 | Richter | 206/521 |
| 3,992,849 | 11/1976 | Lett | 53/472 |
| 4,232,816 | 11/1980 | Johnson et al. | 229/33 |
| 4,553,671 | 11/1985 | Cheesman | 206/611 |
| 4,684,023 | 8/1987 | Cortopassi | 206/459 |
| 4,746,010 | 5/1988 | Fournier | 206/45.14 |
| 4,865,200 | 9/1989 | Sullivan et al. | 206/585 |
| 4,887,717 | 12/1989 | Secrest, Jr. | 206/575 |
| 4,901,911 | 2/1990 | Drerxhage | 229/114 |
| 5,110,038 | 5/1992 | Pantisano et al. | 229/103 |
| 5,358,176 | 10/1994 | Rigby | 229/240 |
| 5,476,214 | 12/1995 | Fisk, Jr. | 229/103 |

*Primary Examiner*—Linda Johnson

[57] ABSTRACT

An apparatus, means and system are described for providing a load center container apparatus for use with a load center, in which a container is adapted to receive a load center, wherein the container has a plurality of sides, an open top and a closed bottom, and a cover adapted to cover said open top of the container, wherein the container apparatus has a removable load center protector that is adapted for mounting on a load center. A method is also described for providing a method for protecting a load center using a load center packaging assembly having a load center protector.

16 Claims, 6 Drawing Sheets

30
35
37a
35o
32d
32e
35p
37
32b
32c 36
35o
30
35p
37r
37s
37q
37a
37t
37p
37o
37n
37u
32s
32o
32q
32d
32a
32f
32e
32p
32b
32r
32e

LOAD CENTER PACKAGING WITH AN INTEGRAL LOAD CENTER PROTECTOR

This application is a division of application Ser. No. 08/688,915 filed Jul. 31, 1996.

BACKGROUND OF THE INVENTION

1. Field of the Invention

This invention relates to an apparatus, means and method for providing a container, carton or package for a load center, in which the container, carton or package has integral and separable sections that may be used to aid in protecting a load center from various contaminants or other damage during and after installation.

2. Description of Art

Electrical load centers, such as are used in residential applications, may be shipped or transported in their own containers, cartons or other such packaging. When the load centers are installed, they are removed from such packaging. When a load center is installed, such as by mounting it flush in a wall or on a load center mounting board, the face plate or trim plate may be left off temporarily so that the load center may be wired more easily. However, where the interior components of the load center are left exposed, they may become contaminated or damaged by dirt, paint or other contaminants that may, for example, accompany adjacent construction activity. For example, where the load center is mounted flush between wall studs, painting the surrounding walls may result in paint contaminating the interior load center components unless the load center components are first somehow covered or otherwise protected in some way.

Consequently, it is believed that there is a need for a load center container, carton or packaging system that includes an integral load center protector. There is also a need for such a container, carton or packaging system, in which the integral load center protector is adapted so that it may be installed in place by using load center protector flanges to secure the load center protector with respect to the enclosure flanges of the load center enclosure that houses the interior load center components.

SUMMARY OF THE INVENTION

It is an object of the present invention to advance or improve the existing art.

It is another object of the present invention to provide a load center container apparatus for use with a load center, comprising a container adapted to receive a load center, wherein the container has a plurality of sides, an open top and a closed bottom, and a cover adapted to cover the open top of the container, wherein the container apparatus has a removable load center protector that is adapted for mounting on a load center.

It is yet another object of the present invention to provide a load center container apparatus for use with a load center, comprising a container means for receiving a load center, where the container means has a plurality of sides, an open top and a closed bottom, and a cover means for covering the open top of the container means, wherein the container apparatus has a removable load center protector means for mounting on a load center.

It is still another object of the present invention to provide a load center container system comprising a load center, a container adapted to receive the load center, wherein the container has a plurality of sides, an open top and a closed bottom, and a cover adapted to cover the open top of the container, wherein the container apparatus has a removable load center protector that is adapted for mounting on the load center.

It is yet another object of the present invention to provide a load center container system for use with a load center, comprising a load center means, a container means for receiving the load center, where the container means has a plurality of sides, an open top and a closed bottom, and a cover means for covering the open top of the container means, wherein the container apparatus has a removable load center protector means for mounting on the load center.

It is still another object of the present invention to provide a method for protecting a load center using a load center protector, where the load center protector has a plurality of interior foldable flanges, comprising the following steps: folding at least two of the plurality of interior foldable flanges of the load center protector, positioning the load center protector over the load center, and inserting at least two of the plurality of interior foldable flanges into an interior area of the load center.

It is yet another object of the present invention to provide a method for protecting a load center using a load center container apparatus, where the load center container apparatus has a removable load center protector having a plurality of interior foldable flanges, comprising the following steps: removing the removable load center protector from the load center container apparatus, folding at least two of the plurality of interior foldable flanges of the removable load center protector, positioning the load center protector over the load center, and inserting at least two of the plurality of interior foldable flanges of the load center protector into an interior area of the load center.

These and other objects, advantages and features of the present invention will be readily understood and appreciated with reference to the detailed description of preferred embodiments discussed below together with the accompanying drawings.

DETAILED DESCRIPTION OF THE PREFERRED EMBODIMENT

Figure 1A:
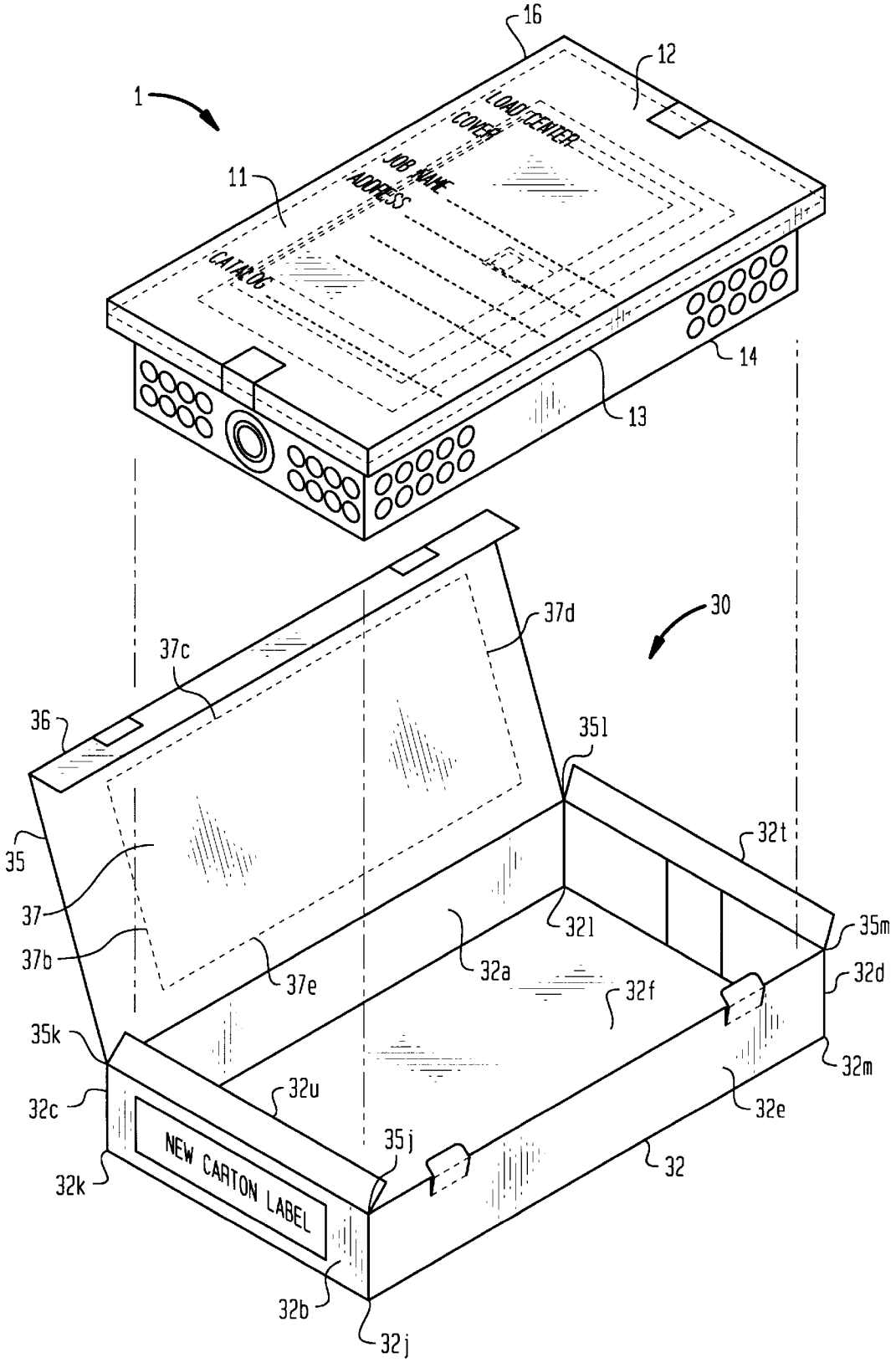
FIG. 1A is a drawing of an embodiment of the load center packaging assembly system having an integral load center protector.

Referring to FIGS. 1A to 4B, the load center container or packaging system 1 comprises a load center assembly 10 and a load center packaging assembly 30. The load center packaging assembly 30 further comprises a container, carton or package 32 and a load center cover 35, which is hinged along one side edge 32*a* of the carton, container or package 32. In FIG. 1A, the load center carton 32 preferably has four rectangular sides 32*b*, 32*c*, 32*d* and 32*e*. Alternatively, in FIG. 1B, each of the four sides 32*b*, 32*c*, 32*d* and 32*e* has a trapezoidal shape so that a flush-mount load center assembly 10 may sit relatively securely within the carton 32. As shown in FIGS. 1A and 1B, the load center assembly 10 is a flush-mount load center. A flush-mount load center assembly 10 is one that sits flush in a wall, and may be mounted between the wall studs. Load centers are well known in the art, and, of course, any type load center assembly may be used. The load center assembly 10 comprises a trim and door assembly 13, a load center enclosure 14 and interior load center components 15 (see FIGS. 3 and 4A). As shown in FIGS. 1A and 1B, for shipping, the load center assembly 10 may be packed in a packing material 11, such as bubble packaging material. In both FIGS. 1A and 1B, the container 32 is covered by a cover 35 having an integral load center protector 37. As shown, the cover 35 may be hingedly connected on one edge side 32*a* of the carton 32. Finally, as shown in FIG. 1A, the carton or container 32 has carton foldable side flanges 32*u* and 32*t*.

Figure 1B:
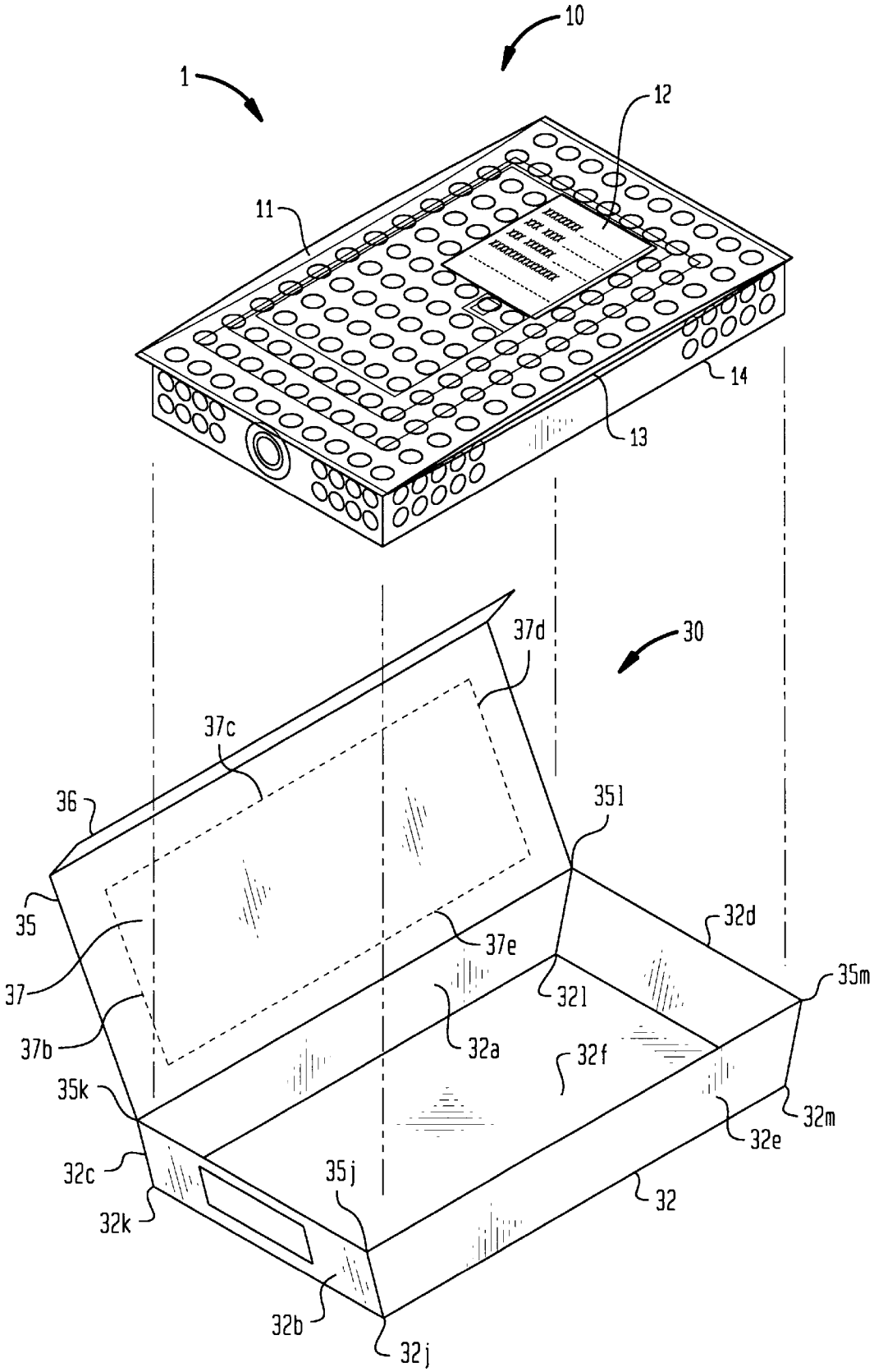
FIG. 1B is a drawing of an alternative embodiment of the load center packaging assembly system having an integral load center protector.

As shown in FIG. 1B, since the load center assembly 10 is a flush-mount load center, the trim and door assembly 13 has a larger footprint than does the load center enclosure 14. Accordingly, the smaller footprint of the load center enclosure 14 fits within the smaller footprint of a bottom 32*f*, which is bounded by lower corners 32*j*, 32*k*, 32*l* and 32*m*, of the carton 32. Similarly, the larger footprint of the trim and door assembly 13 of the load center assembly 10 fits within the larger footprint of the top area or portion of the carton 32 bounded by upper corners 35*j*, 35*k*, 35*l* and 35*m*.

Figures 2A, 2B:
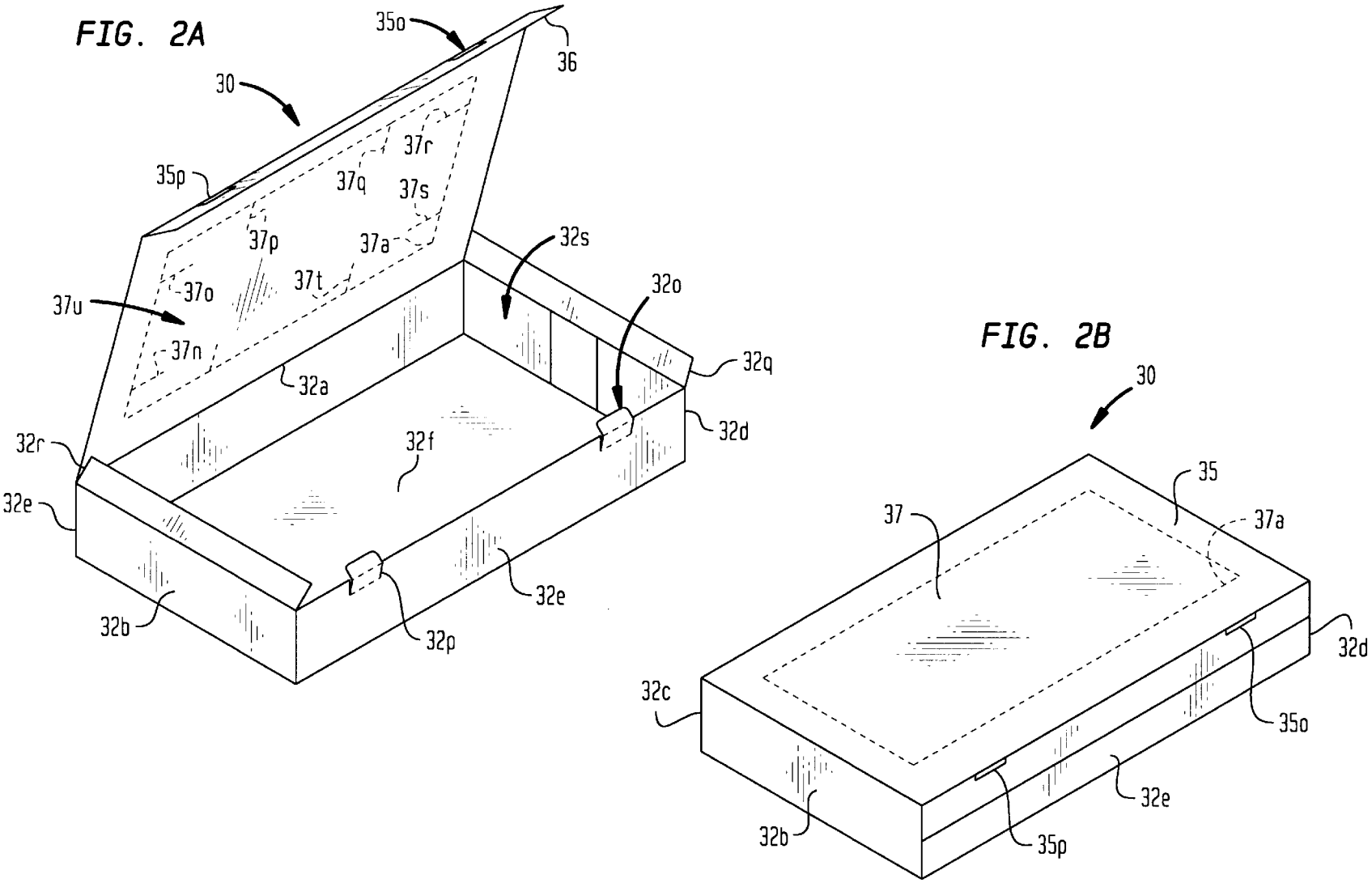
FIGS. 2A and 2B are additional drawings of the load center packaging assembly having an integral load center protector.

As shown in FIG. 2A, the carton 32 also has integral foldable locking tabs 32*o* and 32*p*, which are used to secure the cover 35 and integral load center protector 37 when the load center packaging assembly 30 has been opened. The cover 35, having the integral load center protector 37, has a cover foldable flange 36, which has locking tab apertures or openings 35*o* and 35*p* that are designed to receive the locking tabs 32*o* and 32*p*, respectively, so as to secure the cover 35 and integral load center protector 37 when the load center packaging assembly 30 has been opened. Prior to shipping, the inner side of the cover foldable flange 36 is glued to the top portion of the outer side of side 32*e*.

Figure 3:
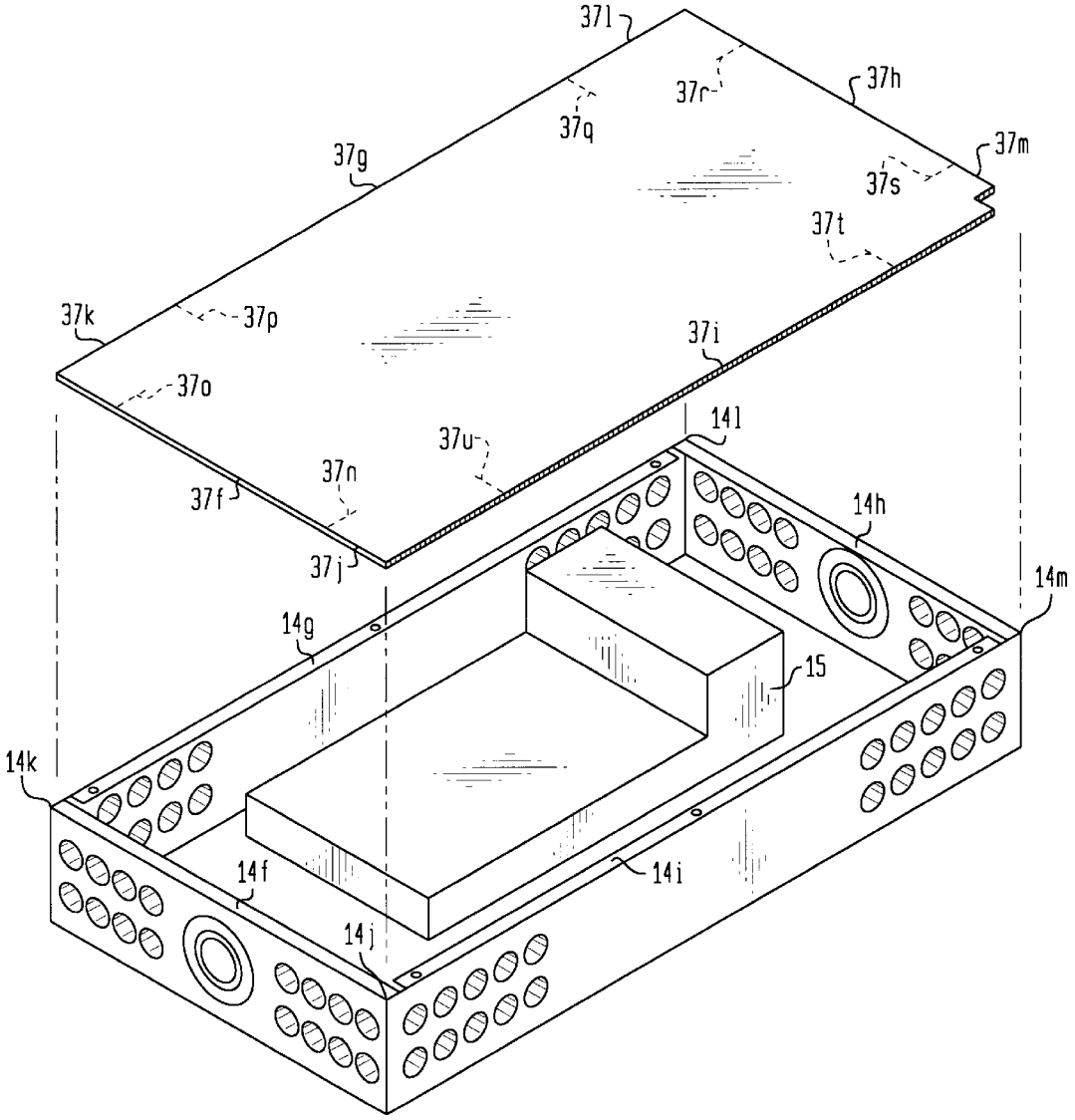
FIG. 3 is a drawing of the integral load center protector and the load center enclosure without the trim and door assembly.
Figure 4A:
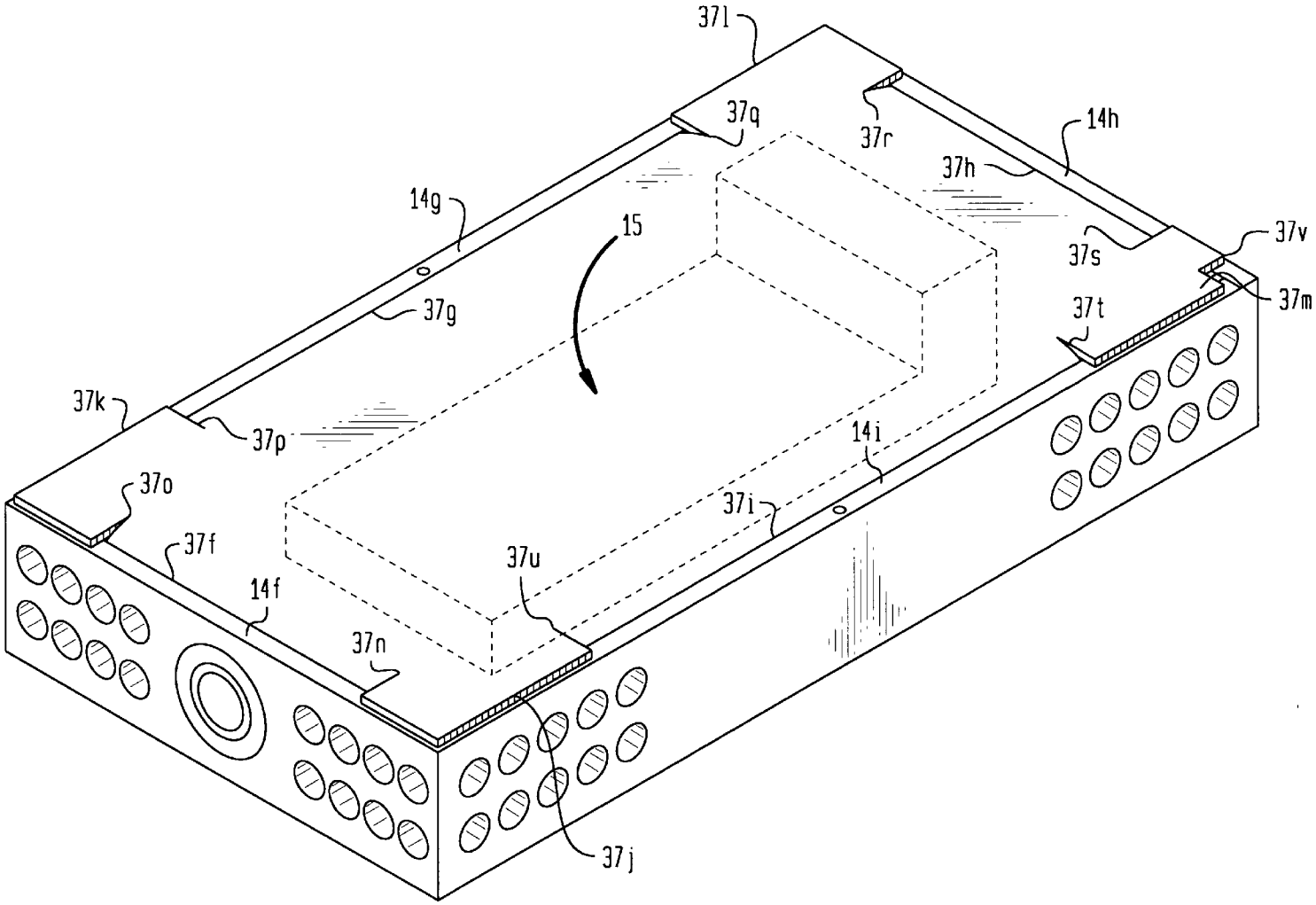
FIGS. 4A and 4B are drawings of the way in which the load center protector is attached, mounted or secured with respect to the load center enclosure so as to aid in protecting the interior load center components.
Figure 4B:
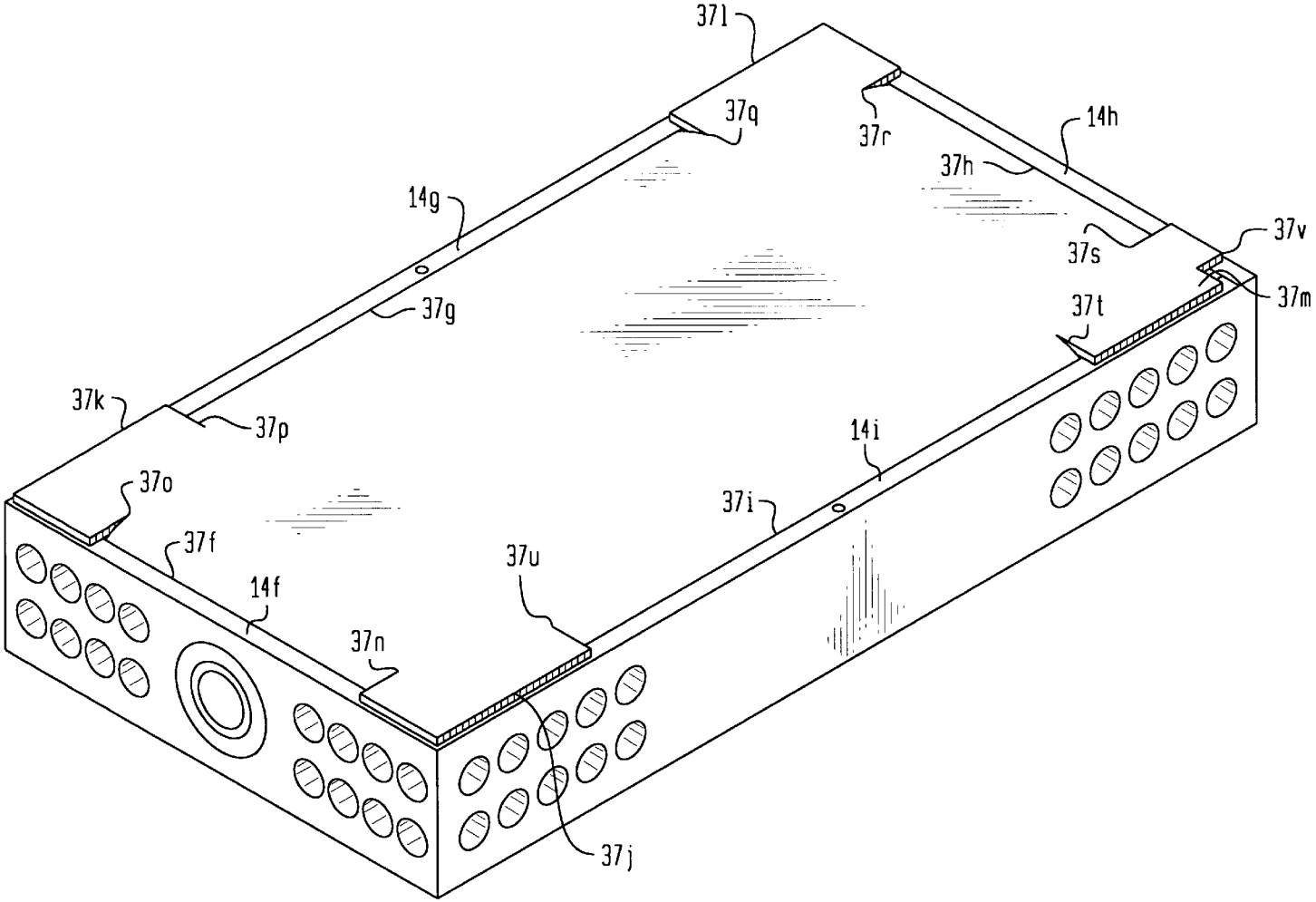

The integral load center protector 37 is removably connected to the main part of the cover 35. Referring to FIGS. 2B and 3, the integral load center protector 37 may be removed by punching out a finger-hold portion 37*a* of integral load center protector 37. A user may then insert a forefinger into finger-hold aperture or opening 37*b*, and remove the integral load center protector 35*b* by breaking or separating the apertured or perforated lines 37*b*, 37*c*, 37*d* and 37*e*. Additionally, the integral load center protector 37 has eight apertured or perforated lines 37*n*, 37*o*, 37*p*, 37*q*, 37*r*, 37*s*, 37*t* and 37*u*. Each of the apertured or perforated lines 37*n*, 37*o*, 37*p*, 37*q*, 37*r*, 37*s*, 37*t* and 37*u* are perpendicular to the edge of the outer side from which they begin, respectively. Each apertured or perforated line 37*n*, 37*o*, 37*p*, 37*q*, 37*r*, 37*s*, 37*t* and 37*u* may be on the order of about several inches in length.

The integral load center protector 37 may be secured to the load center enclosure 14 in the following way. First, interior flanges or portions 37*f*, 37*g*, 37*h* and 37*i* of the integral load center protector 37 are folded downwardly. Next, the folded interior flanges or portions 37*f*, 37*g*, 37*h* and 37*i* are inserted under the enclosure flanges 14*f*, 14*g*, 14*h* and 14*i* of the load center enclosure 14 into the interior of the load center enclosure 14, while the upper corner portions 37*j*, 37*k*, 37*l* and 37*m* rest or sit on the upper corner edges 14*j*, 14*k*, 14*l* and 14*m* of the load center enclosure 14. It should be understood that the integral load center protector may also be associated with the bottom 32*f* of the carton 32, rather than the cover 35. Further, any other suitably appropriate method may be used to secure the load center protector 37 to the load center enclosure 14.

As described above, this approach provides a method for protecting a load center assembly 10 using a load center container assembly 30, where the load center container 30 has a removable load center protector 37 having a plurality of interior foldable flanges 37*f*, 37*g*, 37*h*, and 37*i*, comprising the following steps: removing the removable load center protector 37 from the load center container 30; folding at least two of the plurality of interior foldable flanges 37*f*, 37*g*, 37*h*, and 37*i* of the removable load center protector 37; positioning the load center protector 37 over the load center assembly 10; inserting at least two of the plurality of interior foldable flanges 37*f*, 37*g*, 37*h*, and 37*i* of the load center protector 37 into an interior area of the load center assembly 10.

In this way, when the load center enclosure 14 is mounted, for example, between a pair of wall studs so as to be mounted flush with respect to the wall, the integral load center protector 37 aids in better protecting the interior load center components 15 from dust, paint or other contaminants that may be associated, for example, with adjacent construction activity, or from the adjacent construction activity itself. Fox example, where the flush-mount load center is in a wall that is being painted, the integral load center protector 37 aids in better protecting the interior load center components 15 from the paint.

While the present invention has been described in connection with what are the most practical and preferred embodiments as currently contemplated, it should be understood that the present invention is not limited to the disclosed embodiments. Accordingly, the present invention is intended to cover various modifications and equivalent arrangements, methods and structures that are within the spirit and scope of the claims.

What is claimed is:

1. A method of covering an open front of a wall-mount electric enclosure that comprises a walled perimeter bounding the open front and having a flange that is directed inwardly of the open front along at least a portion of the length of the walled perimeter of the enclosure, the method including the steps of:

opening a walled container containing the enclosure;

removing from a wall portion of the container, a cover wall that has a perimeter margin; and placing the cover wall in covering relation to at least a portion of the open front of the enclosure, including inserting a first portion of the perimeter margin of the cover wall into the enclosure along a corresponding first portion of the length of the walled perimeter of the enclosure containing the flange while disposing a second portion of the perimeter margin of the cover wall against the exterior of the enclosure in overlapping relation to a second portion of the length of the walled perimeter of the enclosure;

wherein the step of inserting a first portion of the perimeter margin of the cover wall into the enclosure along a corresponding first portion of the length of the walled perimeter of the enclosure containing the flange comprises inserting the first portion of the perimeter margin of the cover wall into the enclosure along a first pair of opposite parallel sides of the walled perimeter of the enclosure and along a second pair of opposite parallel sides of the walled perimeter of the enclosure that are transverse to the first pair of opposite parallel sides.

2. A method as set forth in claim 1 in which the step of disposing a second portion of the perimeter margin of the cover wall against the exterior of the enclosure in overlapping relation to a second portion of the length of the walled perimeter of the enclosure comprises disposing corners of the cover wall against corresponding portions of the flange at corners of the walled perimeter of the enclosure where the first pair of opposite parallel sides adjoin the second pair of opposite parallel sides.

3. A method as set forth in claim 1 in which the step of disposing a second portion of the perimeter margin of the cover wall against the exterior of the enclosure in overlapping relation to a second portion of the length of the walled perimeter of the enclosure comprises disposing comers of the cover wall against corresponding corners of the walled perimeter of the enclosure where the first pair of opposite parallel sides adjoin the second pair of opposite parallel sides.

4. A method as set forth in claim 1 including the step of creating slits in the perimeter margin of the cover wall at particular locations to allow the first portion of the perimeter margin of the cover wall to be inserted into the enclosure, wherein the slits extend inward from an outer edge of the perimeter margin of the cover wall.

5. A method of covering an open front of a wall-mount electric enclosure that comprises a multi-cornered walled perimeter bounding the open front and having a flange that is directed inwardly of the open front around the walled perimeter of the enclosure, the method including the steps of:

opening a walled container containing the enclosure;

removing from a wall portion of the container, a cover wall that has a perimeter margin; and placing the cover wall in covering relation to at least a portion of the open front of the enclosure, including disposing a first portion of the perimeter margin of the cover wall against the flange at at least one corner of the walled perimeter and inserting a second portion of the perimeter margin of the cover wall into the enclosure along the walled perimeter contiguous the at least one corner.

6. A method as set forth in claim 5 in which the step of disposing a first portion of the perimeter margin of the cover wall against the flange at at least one corner of the walled perimeter comprises disposing the first portion of the perimeter margin of the cover wall against the flange at all corners of the walled perimeter.

7. A method of making a cover wall for covering at least a portion of an open front of a wall-mount electric enclosure that comprises a multi-cornered walled perimeter, and of installing the cover wall on such an enclosure, the method including the steps of:

providing a walled container; and removing from a wall portion of the container, a multi-cornered cover wall that has a perimeter margin corresponding to the multi-cornered walled perimeter of the open front of the enclosure, including creating slits in the perimeter margin of the cover wall at particular locations along the lengths of sides of the cover wall that extend between corners of the cover wall, wherein the slits extend inward from an outer edge of the perimeter margin of the cover wall; and including the further step of placing the cover wall in covering relation to at least a portion of the open front of such an enclosure, including disposing corners of the cover wall against corresponding corners of the walled perimeter of the enclosure and inserting sides of the cover wall between slits therein into the enclosure along the walled perimeter of the enclosure.

8. A method of covering an open front of an electric load center enclosure that comprises a walled perimeter bounding the open front and having a flange that is directed inwardly of the open front along at least a portion of the length of the walled perimeter of the enclosure, the method comprising:

providing a cover wall that has a perimeter margin; and placing the cover wall in covering relation to at least a portion of the open front of the enclosure, including inserting a first portion of the perimeter margin of the cover wall into the enclosure along a corresponding first portion of the length of the walled perimeter of the enclosure containing the flange while disposing a second portion of the perimeter margin of the cover wall against the exterior of the enclosure in overlapping relation to a second portion of the length of the walled perimeter of the enclosure;

wherein the step of inserting a first portion of the perimeter margin of the cover wall into the enclosure along a corresponding first portion of the length of the walled perimeter of the enclosure containing the flange further comprises inserting the first portion of the perimeter margin of the cover wall into the enclosure along a first pair of opposite parallel sides of the walled perimeter of the enclosure and along a second pair of opposite parallel sides of the walled perimeter of the enclosure that are transverse to the first pair of opposite parallel sides.

9. A method as set forth in claim 8 in which the step of disposing a second portion of the perimeter margin of the cover wall against the exterior of the enclosure in overlapping relation to a second portion of the length of the walled perimeter of the enclosure comprises disposing corners of the cover wall against corresponding portions of the flange at comers of the walled perimeter of the enclosure where the first pair of opposite parallel sides adjoin the second pair of opposite parallel sides.

10. A method as set forth in claim 8 in which the step of disposing a second portion of the perimeter margin of the cover wall against the exterior of the enclosure in overlapping relation to a second portion of the length of the walled perimeter of the enclosure comprises disposing comers of the cover wall against corresponding corners of the walled perimeter of the enclosure where the first pair of opposite parallel sides adjoin the second pair of opposite parallel sides.

11. A method as set forth in claim 8 including the step of creating slits in the perimeter margin of the cover wall at particular locations to allow the first portion of the perimeter margin of the cover wall to be inserted into the enclosure, wherein the slits extend inward from an outer edge of the perimeter margin of the cover wall.

12. A method as set forth in claim 8 wherein the cover wall is created by removing a wall portion of a walled container for the enclosure, and using the removed wall portion as the cover wall.

13. A method of covering an open front of an electric load center enclosure that comprises a multi-comered walled perimeter bounding the open front and having a flange that is directed inwardly of the open front around the walled perimeter of the enclosure, the method comprising:

providing a cover wall that has a perimeter margin; and placing the cover wall in covering relation to at least a portion of the open front of the enclosure, including disposing a first portion of the perimeter margin of the cover wall against the flange at at least one corner of the walled perimeter and inserting a second portion of the perimeter margin of the cover wall into the enclosure along the walled perimeter contiguous the at least one comer.

14. A method as set forth in claim 13 in which the step of disposing a first portion of the perimeter margin of the cover wall against the flange at at least one corner of the perimeter margin comprises disposing the first portion of the perimeter margin of the cover wall against the flange at all comers of the perimeter margin.

15. A method as set forth in claim 13 wherein the cover wall is created by removing a wall portion of a walled container for the enclosure, and using the removed wall portion as the cover wall.

16. A method of making a cover wall for covering at least a portion of an open front of an electric load center enclosure that comprises a multi-cornered walled perimeter, and of installing the cover wall on such an enclosure, the method comprising:

providing a walled container, and removing from a wall portion of the container, a multi-cornered cover wall that has a perimeter margin corresponding to the multi-cornered walled perimeter of the open front of the enclosure, including creating slits in the perimeter margin of the cover wall at particular locations along the lengths of sides of the cover wall that extend between corners of the cover wall, wherein the slits extend inward from an outer edge of the perimeter margin of the cover wall; and including the further step of placing the cover wall in covering relation to at least a portion of the open front of such an enclosure, including disposing corners of the cover wall against corresponding comers of the enclosure and inserting sides of the cover wall between slits into the enclosure.

* * * * *